United States Patent [19]

Niemiec

[11] Patent Number: 4,745,867

[45] Date of Patent: May 24, 1988

[54] LEG ATTACHMENT BRACKET FOR PRESSBOARD TABLES

[75] Inventor: Leo P. Niemiec, Northfield, Ill.

[73] Assignee: Lawnware Products, Inc., Morton Grove, Ill.

[21] Appl. No.: 127,199

[22] Filed: Dec. 1, 1987

[51] Int. Cl.[4] ..... F16M 11/16

[52] U.S. Cl. ..... 108/157; 248/188; 248/188.8; 403/406.1

[58] Field of Search ..... 108/157, 158, 159; 248/188, 188.8, 558; 403/406.1, 405.1

[56] References Cited

U.S. PATENT DOCUMENTS

| | | | |
|---|---|---|---|
| 1,733,859 | 10/1929 | Brubaker | 248/188 |
| 1,812,967 | 7/1931 | Long | 248/188 X |
| 2,852,221 | 9/1958 | Steiner | 248/188 |
| 3,175,794 | 3/1965 | Beene III | 248/188 |
| 3,385,239 | 5/1968 | Fossier et al. | 248/188.8 |
| 3,516,633 | 6/1970 | Blackwood | 248/188 |
| 3,620,492 | 11/1971 | Jennings | 248/188 |
| 4,033,653 | 7/1977 | Doring et al. | 248/188 X |
| 4,066,295 | 1/1978 | Severson | 248/188 X |

FOREIGN PATENT DOCUMENTS

| | | | |
|---|---|---|---|
| 349929 | 3/1922 | Fed. Rep. of Germany | 248/188 |
| 896578 | 5/1962 | United Kingdom | 248/188 |

*Primary Examiner*—Peter A. Aschenbrenner

*Attorney, Agent, or Firm*—Tilton, Fallon, Lungmus & Chestnut

[57] ABSTRACT

The present invention utilizes a leg attachment bracket of novel design for securely but removably attaching legs to table tops having pressboard cores. This bracket, which can be molded in one piece from plastic, is provided with perimetric flanges united by a recessed horizontally-extending web. The top edges of the flanges are in planar alignment and bear against the bottom surface of the table top for adhesively bonding thereto. Locator opening are provided in the bracket through which screws can extend for initial attachment during the setting of the adhesive. The top side of bracket provides a plurality of sockets surrounding openings in which T nuts can be seated. The T-nuts are accessible from the bottom side of the bracket. This permits the legs to be releasably connected to the top, while the bracket is permanently attached.

14 Claims, 2 Drawing Sheets

LEG ATTACHMENT BRACKET FOR PRESSBOARD TABLES

FIELD OF INVENTION

The field of this invention is mechanical means for removable attachment of legs to table tops; and, in particular, attachment of legs to table tops formed from pressboard.

BACKGROUND OF INVENTION

Casual tables for use on porches and patios commonly have tops with cores of fibrous material which provide relatively weak support for attachment of screws, T-nuts, and the like. Such cores are formed from fibrous material, such as wood fibers, which are molded into sheet form, usually with organic polymer binders. Such materials are generically referred to herein as "pressboard".

Pressboard is a lightweight, relatively inexpensive material which can be made into durable table tops by laminating a hard plastic sheet to the top and side edges.

A common commercial practice for attaching legs to pressboard table tops employs T-nuts, which are seated on the underside of the table, and arranged in groups for receiving bolts connecting the legs. This type of construction permits the detachment of the legs for shipping or storage, but it does not provide a sufficiently sturdy leg attachment for long-term use of the tables. Because of the structural weakness of the pressboard material, the T-nuts loosen rather easily, and the table legs can become wobbly. Leverage forces exerted by the table legs tend to aggravate this problem. With continued use of the tables the T-nuts can become separated from the table tops. It is difficult for the users to securely reattach the table legs. In home use, the owner does not ordinarily have available the required tools for re-insertion of T-nuts.

Table legs have sometimes been adhesively bonded to pressboard table tops. This has the disadvantage that the legs cannot be removed, making the tables more bulky for shipment and less convenient for storage. Compact storage is often desired for porch or patio furniture during the winter season. Heretofore, no satisfactory answer to these problems has been provided.

SUMMARY OF INVENTION

The present invention utilizes a leg attachment bracket of novel design for securely but removably attaching legs to table tops having pressboard cores. This bracket, which can be molded in one piece from plastic, is provided with perimetric flanges united by a recessed horizontally-extending web. The top edges of the flanges are in planar alignment and bear against the bottom surface of the table top for adhesively bonding thereto. Locator openings are provided in the bracket through which screws can extend for initial attachment during the setting of the adhesive. The top side of the bracket provides a plurality of sockets surrounding openings in which T-nuts can be seated. The T-nuts are accessible from the bottom side of the bracket. This permits the legs to be releasably connected to the top, while the bracket is permanently attached.

To obtain added stability for the bracket, it is preferred to provide it with a plurality of extension or stabilizer wings located adjacent its T-nut sockets. The brackets may be equipped with several alternate sets of T-nut sockets. One set may be arranged for use with table leg attachment flanges of triangular configuration, another may be arranged in a square pattern for legs having similarly shaped attachment flanges, etc.

THE DRAWINGS

The accompanying drawings illustrate a preferred embodiment of the table leg attachment bracket of this invention, and its assembly for releasably connecting the legs to table tops having pressboard cores.

DETAILED DESCRIPTION

The attachment bracket of this invention can be employed for table and leg assemblies with a variety of table tops and legs of different sizes and shapes. The bracket is adapted for use with table tops which are round, oval, square, rectangular, etc. It can be used for attachment of three, four, or more legs, if desired. The bracket can be adapted for use. The legs msy have a triangular attachment flange, or a square attachment flange, or one of another shape. The bracket can be adapted for almost universal application. The brackets of this invention may be molded in one piece from a suitable plastic such as a high impact polystyrene.

In preferred embodiments, the bracket is used with table tops which have a pressboard core. The term "pressboard" is used here generically as referring to molded board or sheet material formed from wood or other cellulosic fibers united by organic polymer binders. As manufactured for table top use, the pressboard usually has a hard, durable surface material laminated to its top and side edges. For example, a "Formica" laminate may be used. The underside of the table is generally planar, and is not laminated, but may have a protective water-resistant coating. Table tops ready for assembly into tables can be obtained commercially, for example, the "Werzalite" tables, sold by the Werzalite Company of America (here insert city and state where located.)

Figure 1:
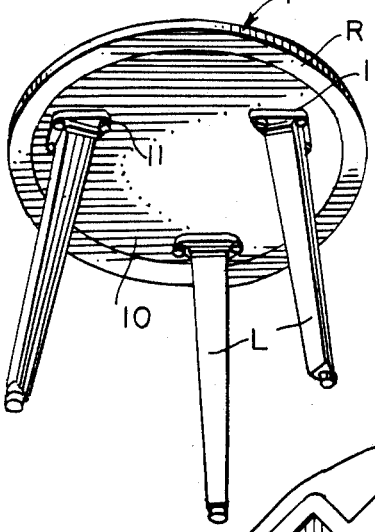
FIG. 1 is a perspective view of the underside of an illustrative table having three legs with generally triangular attachment flanges.

An illustrative table is illustrated in FIG. 1 which is round and has laminated top and sides. The underside of the table, as shown, has been molded with a rim R surrounding a recessed planar center portion 10 to which the legs L are attached. In the illustration shown, the legs are formed from molded plastic with a generally triangular cross-section and have triangular attachment flanges 11 at their upper ends.

Figure 3:
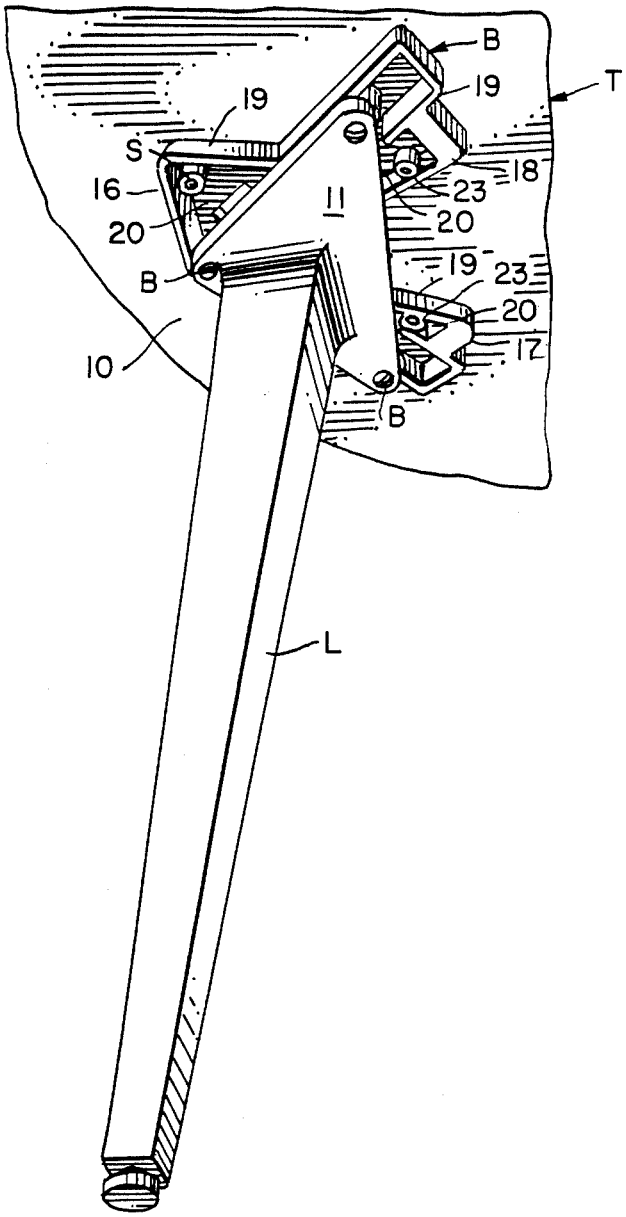
FIG. 3 is a fragmentary perspective view showing the bracket permanently attached to the table and a leg releeasably connected to the bracket.

The attachment brackets are not illustrated in FIG. 1, but it should be understood that each of the legs is attached by means of a bracket B as shown in FIG. 3. The bracket and its method of use will now be described in detail.

Figure 2:
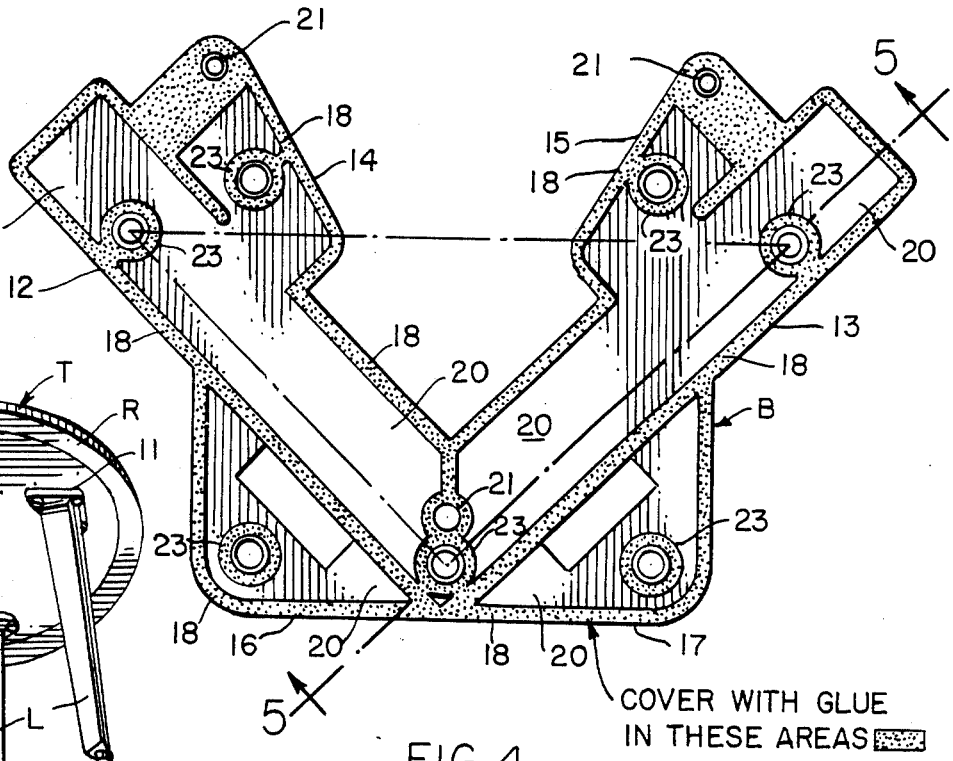
FIG. 2 is a top plan view of the bracket ready for attachment to the underside of the table.
Figure 4:
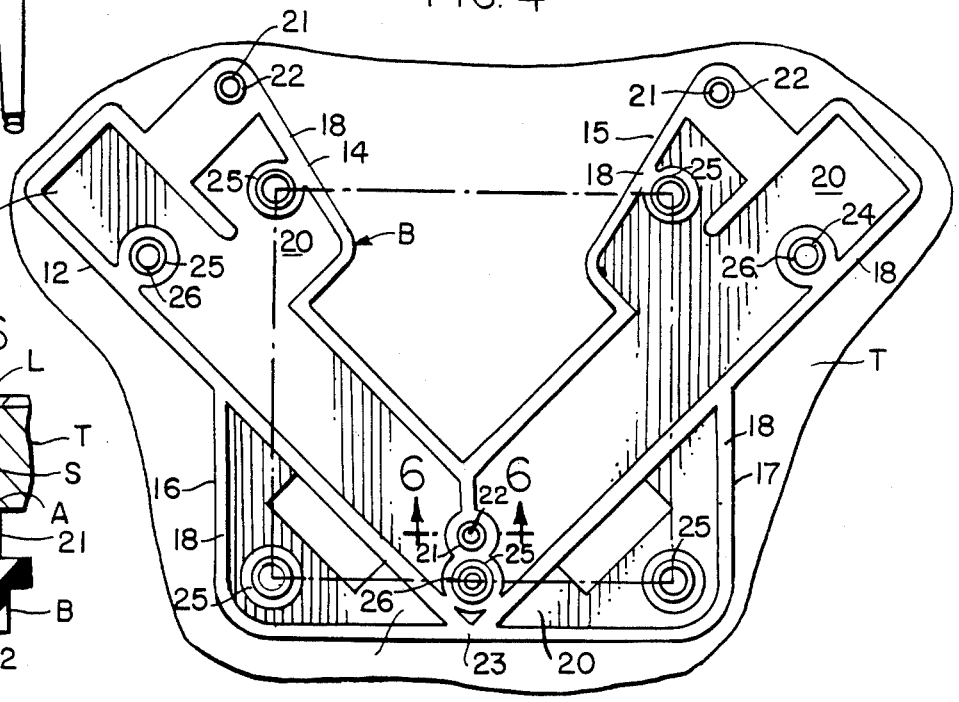
FIG. 4 is a bottom view of the bracket attached to a table top with the leg, which indicates an alternate arrangement for leg attachment.

FIGS. 2 and 4 are plan views of the bracket B, FIG. 2 showing the bracket from the top and FIG. 4 from the bottom. In this embodiment, the bracket includes arms 12 and 13 arranged in a generally V-shaped configuration. Adjacent the outer ends of the arms, laterally-extending wing portions 14 and 15 are provided. At the inner ends of the arms adjacent their intersections, laterally-extending wing portions 16 and 17 are also provided.

The peripheral portions of the arms 12 and 13, and also, preferably, the peripheral portions of the wings 14, 15, 16 and 17 are provided with vertically-aligned flanges, the top edges 18 of which are seen in FIG. 2. These perimetric flanges, designated generally by the number 19, can be seen more clearly in the perspective view of FIG. 3. They are connected by a recessed integral horizontally-extending web, designated generally by the number 20. Web 20 as shown is recessed with respect to both the top and bottom edges of the flange, being the web 20 located along a central plane of the flanges.

Figure 6:
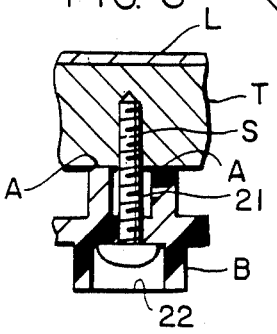
FIG. 6 is a fragmentary sectional view taken on line 6—6 of FIG. 4, showing one of the locator openings and attachment screws used for initial attachment of the bracket.

The top edges of the flanges 18 (FIG. 2) have a planar alignment, and are intended to bear against the planar undersurface of the table (FIG. 3). For permanent attachment, the upper edges of the flanges 18 are coated with a suitable adhesive, as indicated in FIG. 2, by the dots or flecks thereon. In the completed assembly, the adhesive provides a secure bond between the bracket and the table top. The adhesive layers A are shown in the sectional views of FIGS. 5 and 6. The binding adhesive is not a critical feature of this invention. Any of the available commercial adhesives for bonding plastic to wood can be used. For example, a styrene base adhesive can be used, such as the E-6000 adhesive supplied by Ealectic Products, Inc., San Pedro, Calif.

For initial attachment of the brackets, they are provided with a plurality of locator openings 21. In the illustration given, three of the openings 21 are used, two being in the outer ends of the wings 14 and 15, and the other at the intersection of the arms 12 and 13. The locator openings may be provided in other positions, and additional locator openings may be used.

As shown in FIG. 4, for the initial attachment of bracket B screw S can extend through the locator openings 21, with their heads seated in recesses 22 and extending into the table top. These screws can also provide reinforcement of the adhesive attachment, but the screws would not be adequate for a permanent-type attachment of the brackets.

Figure 5:
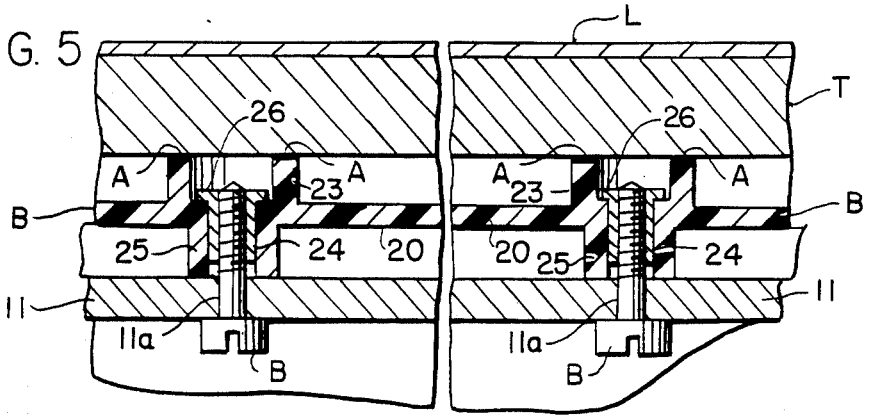
FIG. 5 is a fragmentary sectional view taken on line 5—5 of FIG. 2, showing the socket and T-nut attachment assembly.

To facilitate removable attachment of the legs, the top of the bracket is provided with a plurality of sockets 23 surrounding recessed openings 24, as shown more clearly in the sectional view of FIG. 5. The openings 24 are enclosed below web 20 by tubular extensions 25 which bear against the top of the leg flange 11.

Looking primarily at FIG. 5 it can be seen that T-nuts 26 can be seated within the sockets 23. The T-nuts include an outwardly-extending flange portion at the top, which locks the T-nuts within the sockets. In the completed assembly, bolts B extend through openings 11*a* in the leg flanges, and are threadedly connected to the T-bolts, thereby forming a secure but releasable attachment between the legs and brackets.

Where the table leg has a triangular flange, as shown in FIG. 3, the three socket openings connected by the broken triangular lines in FIG. 2 can be employed. In embodiments where the table leg has a flange of square configuration, the socket openings connected by the broken lines in FIG. 4 may be alternatively employed. For other configurations of the leg flanges, additional or alternative socket openings may be provided.

As can be seen from examining FIGS. 2, 3 or 4, the wing portions 14, 15, 16 and 17 can function as stabilizers for limiting the effect of leverage forces exerted by the table legs. Where a table leg having a triangular flange is used, as illustrated in FIGS. 2 and 3, flanges 14 and 15 extend laterally respectively from the socket openings 23 at the outer end portions of the arms 12 and 13. Similarly, the wing portions 16 and 17 extend outwardly from positions adjacent to socket opening 23 at intersection of the arms. When a four socket opening configuration is used, as shown in FIG. 4, the stabilizer wings themselves can be used to provide the socket openings. Thus, the bracket can provide for attachment of a variety of different legs while still achieving a secure and stabilized assembly.

I claim:

1. A table and leg assembly, comprising a horizontal table top having a planar bottom surface and a pressboard core, a molded plastic bracket positioned on said bottom surface, said bracket having perimetric upwardly-extending flanges united by a recessed horizontally-extending web, the top edges of said flanges bearing against said bottom surface and being adhesively bonded thereto, the top of said bracket providing a plurality of sockets surrounding openings through said web, T-nuts seated in said sockets accessible through said openings from the bottom side of said bracket, a leg extending downwardly from said table top, said leg having a horizontally-projecting flange at the top thereof, said flange providing bolt attaching openings therethrough alignable with a plurality of said socket openings and T-nuts, and bolts extending through said flange openings threadedly connected to the T-nuts.

2. The assembly of claim 1 in which said bracket has at least two sets of said sockets, one set comprising three sockets arranged in a triangular pattern and the other set comprising four sockets arranged in a square pattern.

3. The assembly of claim 1 in which said leg flange is generally triangular in shape and provides one of said bolt-attaching openings in each corner so that three of said bolts can provide the threaded connections.

4. The assembly of claim 1 in which said leg bracket is generally square in shape and provides one of said bolt-attaching openings in each corner thereof so that four of said bolts provide said threaded connections.

5. The assembly of any one of claims 1, 2, 3, or 4 in which said bracket is provided with stabilizer wing positions projecting laterally from a plurality of its socket-providing locations.

6. A table and leg assembly, comprising a horizontal table top having a bottom planar surface and a pressboard core, a molded plastic bracket positioned on said bottom surface, said bracket having perimetric upwardly-extending flanges united by a recessed horizontally-extending integral web, the top edges of said flanges bearing against said bottom surface and being adhesively bonded thereto, the top of said bracket providing at least three sockets surrounding openings through said web, T-nuts seated in said sockets accessible through said openings from the bottom side of said bracket, a leg extending downwardly from said table top, and having a horizontally-projecting flange its top, said flange providing a least three bolt-attachment openings therethrough alignable with said socket openings and T-nuts, and bolts extending through said flange openings threadedly connected to the T-nuts.

7. The assembly of claim 6 in which said bracket has at least two sets of said sockets, one set comprising three sockets arranged in a triangular pattern and the other set comprising four sockets arranged in a square pattern.

8. The assembly of claim 6 in which said leg flange is generally triangular in shape and provides one of said bolt-attaching openings in each corner thereof so that three of said bolts can provide said threaded connections.

9. The assembly of claim 6 in which said leg bracket is generally square in shape and provides one of said bolt-attaching openings in each corner thereof so that four of said bolts can provide said threaded connections.

10. The assembly of any one of claims 6, 7, 8, or 9 in which said bracket is provided with a plurality of stabilizer wing portions projecting laterally from a plurality of its socket-providing locations.

11. A bracket for attachment of a table leg to a pressboard table top, comprising an integrally molded plastic body providing a pair of aligned horizontally-extending arms arranged in a generally V-shaped configuration, said arms having perimetric vertically-aligned flanges united by a recessed horizontally-extending integral web, the top edges of said flanges being in planar alignment for adhesive bonding to a table top, said brackets providing a plurality of locator holes therethrough through which screws can connect to a table top, and said bracket also providing a plurality of sockets around bolt-receiving openings on its top side, said sockets being adapted to receive T-nuts.

12. The bracket of claim 11 in which said bracket is provided with a plurality of stabilizer wing portions projecting laterally from a plurality of its socket-providing locations.

13. The bracket of claim 11 or claim 12 in which said bracket provides at least three of said sockets and socket openings arranged in a triangular pattern, two of said sockets being located in the outer end portions of said arms, and the third socket being located at the intersection of said arms.

14. The bracket of claim 11 in which said bracket is provided with a pair of stabilizer wing portions projecting laterally on each side of the intersection of said arms, said bracket providing at least four of said sockets arranged in a generally square pattern, two of said sockets being located in the outer end portions of said arms, the other two of said sockets being located in said wing portions.

* * * * *